US006717339B2

(12) United States Patent
Marchand

(10) Patent No.: US 6,717,339 B2
(45) Date of Patent: Apr. 6, 2004

(54) LIGHT BULB PROVIDED WITH A DEVICE FOR PREVENTING SHORT-CIRCUITS

(75) Inventor: Jacky Paul Marchand, Maidiéres (FR)

(73) Assignee: Koninklijke Philips Electronics N.V., Eindhoven (NL)

( * ) Notice: Subject to any disclaimer, the term of this patent is extended or adjusted under 35 U.S.C. 154(b) by 76 days.

(21) Appl. No.: 09/961,985

(22) Filed: Sep. 24, 2001

(65) Prior Publication Data

US 2002/0053873 A1 May 9, 2002

(30) Foreign Application Priority Data

Sep. 25, 2000 (FR) ..... 00 12166

(51) Int. Cl.[7] ..... H01K 1/18; H01K 1/24

(52) U.S. Cl. ..... 313/271; 313/273; 313/274; 313/275; 313/279; 313/578; 313/579; 313/636; 445/22; 445/25; 445/26; 445/27; 445/32

(58) Field of Search ..... 313/271, 273, 313/274, 275, 279, 578, 579, 636, 643; 445/22, 25, 26, 27, 32

(56) References Cited

U.S. PATENT DOCUMENTS 3,891,885 A * 6/1975 Wurster ..... 313/557
3,930,177 A 12/1975 Martin ..... 313/271
4,208,606 A * 6/1980 Newton ..... 313/274
4,384,235 A * 5/1983 Bollon et al. ..... 313/276
4,613,787 A * 9/1986 Swain ..... 313/579
4,935,662 A * 6/1990 Kachenmeister et al. ... 313/279
6,017,258 A * 1/2000 Sakurai et al. ..... 445/32

FOREIGN PATENT DOCUMENTS

EP 0271858 B1 6/1988 ..... H01K/1/18
EP 357078 A2 * 3/1990 ..... H01K/1/18

* cited by examiner

*Primary Examiner*—Vip Patel
*Assistant Examiner*—Sikha Roy
(74) *Attorney, Agent, or Firm*—Ernestine C. Bartlett

(57) ABSTRACT

The invention relates to a light bulb comprising a base BA to which a filament FIL is connected, which filament is intended to emit a luminous radiation and has turns arranged in spiraling fashion around an axis of revolution AX. According to the invention, the light bulb in addition comprises a plurality of hooks H1, H2, and H3, each being in contact with one of the turns of the filament, and being connected to the base BA by means of a support SUP. The invention enables to keep the filament FIL securely in position, which reduces the risk that several turns of said filament will come into contact with the support SUP, thus creating a destructive short-circuit.

4 Claims, 1 Drawing Sheet

LIGHT BULB PROVIDED WITH A DEVICE FOR PREVENTING SHORT-CIRCUITS

BACKGROUND

The invention relates to a light bulb comprising a base to which a filament is linked, which filament is intended to emit a luminous radiation and has turns arranged in spiraling shape around an axis of revolution.

Such a light bulb is marketed by applicant under the reference number PL10044067. The filament in this light bulb is kept in position by means of a single metal support of which one end is fixedly united to the base and of which another end comprises a closed hook which surrounds one of the turns of the filament, said two ends of the support being linked by a rod.

The known light bulb is constructed such that, when the light bulb is in its normal operational position, the rod of the support is situated below the filament. Applicant has observed that the filament, when traversed by a current, has a tendency towards mechanical deformation, developing a curvature which displaces in downward direction the ends of the filament on either side of the hook which keeps said filament in position. Thus several turns may come into contact with the rod of the support, which then leads to a short-circuit which may destroy the support and the filament itself.

SUMMARY

The present invention has for its object to avoid all risk of short-circuits due to such a deformation of the filament by proposing a light bulb in which the extent of the deformation of the filament is limited.

To achieve this object, according to the invention, a light bulb as described in the introductory paragraph comprises in addition a plurality of supports, each having an end linked to the base and another end provided with a hook which is in contact with one of the turns of the filament.

The plurality of supports provided in accordance with the invention enables to keep the filament better in position and prevents a simultaneous contacting of several of its turns with one and the same support.

In one of the embodiments of the invention, the hooks are all situated at a same side of the axis of revolution of the filament.

Such an embodiment simplifies the manufacture of the supports, which may thus be formed by a single rod provided with a plurality of hooks. The linking between the supports and the base will also be simplified thereby.

In a special embodiment of the light bulb according to the invention, the supports are designed so as to be situated above the filament when the light bulb is in its normal operating position, and the hooks of the supports are open hooks.

The fact that the hooks are open considerably simplifies the manufacture of the light bulb. Indeed, if the hooks are closed, the filament must be screwed through the eyelets of the hooks, which requires an appreciable amount of time which is reflected in the manufacturing cost of the light bulb. The use of open hooks merely requires the placement of the turns upon the hooks, thus reducing the manufacturing cost of the light bulb.

In a preferred embodiment of the invention, with one end of the filament fixedly united to the base, the other end of the filament is connected to said base via a framework formed by a rod situated within a region inside the turns of the filament and outside a plane defined by the axis of revolution and points of contact between the hooks and the filament, as shown in FIG. 2.

This embodiment of the framework enables to ensure that it (i.e., the framework formed by the rod situated within the region inside the turns of the filament and outside the plane defined by the axis of revolution) will lie outside a path which would be followed by the turns of the filament under the influence of the mechanical deformation observed for the known light bulb, if said turns were not retained in position. Such a choice, therefore, avoids all risk of short-circuits between the filament and the reinforcement element.

BRIEF DESCRIPTION OF THE DRAWINGS

The invention will be better understood from reading of the following description, which is given by way of example to which the invention is not limited, with reference to the annexed drawings, in which.

DETAILED DESCRIPTION

Figure 1:
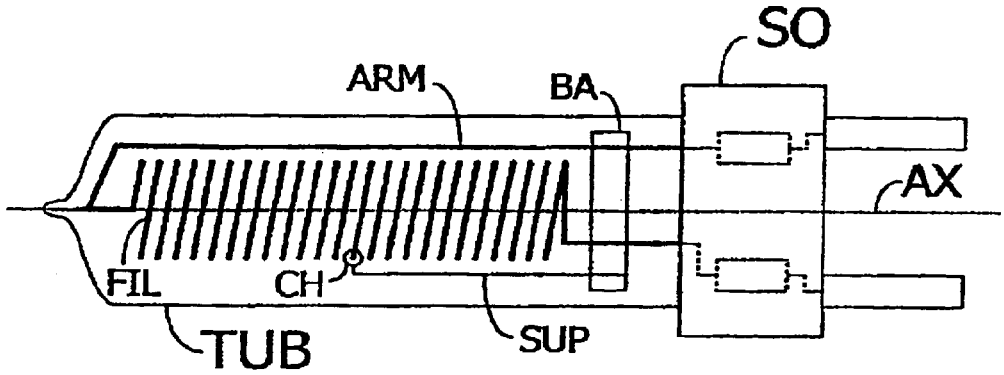
PRIOR ART FIG.1
FIG. 1 is a diagram showing a known light bulb.

FIG. 1 diagrammatically shows a known light bulb in a configuration which corresponds to its normal operating conditions. This light bulb comprises a lamp socket SO and a tube TUB made of a transparent material, for example of glass. This tube encloses a filament FIL which is designed to emit luminous radiation and which has turns which spiral around an axis of revolution AX. One of the ends of this filament FIL is connected to a base BA, while the other end is connected to said base via a framework ARM formed by a metal rod arranged above the filament FIL. The filament FIL and the framework ARM thus form a current circuit which is connected to the lamp socket SO. In the known light bulb, the filament FIL is kept in position by means of a single metal support SUP of which one end is fixedly united to the base BA and another end has a closed hook CH which surrounds one of the turns of the filament FIL, the two ends of the support SUP being linked by a rod which is arranged below the filament FIL. Applicant has observed that the filament FIL, when traversed by a current, has a tendency towards mechanical deformation by developing a curvature in which the ends of the filament FIL situated on either side of the hook, which keeps said filament in position, are displaced in downward direction. Thus several turns may come into contact with the rod of the support SUP, creating a short-circuit which may destroy the support SUP and the filament FIL itself.

Figure 2:
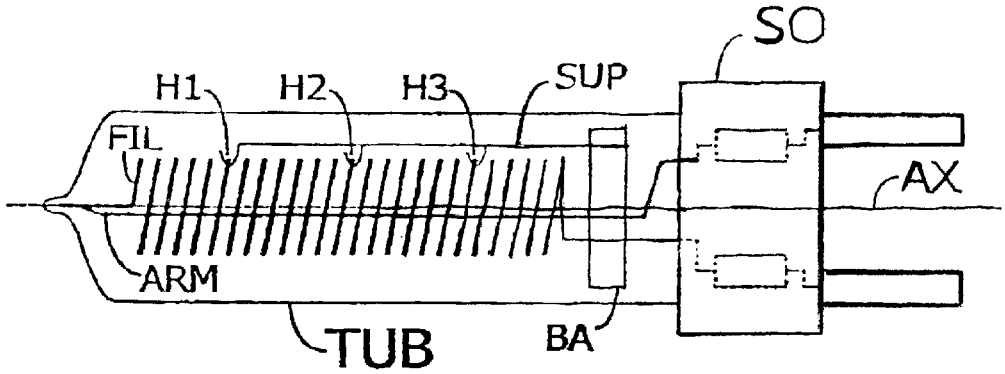
FIG. 2 is a diagram showing a light bulb representing a preferred embodiment of the invention.

FIG. 2 diagrammatically shows a light bulb in a preferred embodiment of the invention, in a configuration corresponding to its normal operating conditions. Elements which are shared with the known light bulb have been given the same reference symbols. In this embodiment of the invention, the filament FIL is kept in position by means of three hooks H1, H2, H3 linked to the base BA via a rod. The invention enables to keep the filament FIL better in position and prevents the latter from becoming deformed in downward direction around the central hook H2.

In this particular embodiment of the invention, the hooks H1, H2, H3 are all situated above the filament FIL, which enables to use only a single rod for connecting said hooks to the base BA, thus further reducing the risk of short-circuits involved in a possible deformation of the filament FIL, which deformation would take place in downward direction. Moreover, the hooks H1, H2, and H3 are open hooks here, which considerably simplifies the manufacture of the light bulb, because the filament can now be laid on said hooks whereas it had to be screwed through the closed hooks.

In this embodiment of the invention, finally, the framework ARM is formed by a rod situated within a region inside the turns of the filament and outside a plane defined by the axis of revolution AX and points of contact between the hooks H1, H2, H3 and the filament FIL, as shown in FIG. 2. Any deformation of the filament FIL can in principal only arise in the plane defined by the axis of revolution AX and said points of contact, so that the particular arrangement of the framework ARM eliminates all risk of contact between said framework and turns of the filament FIL.

What is claimed is:

1. A light bulb comprising a single base to which a filament is linked, which filament is designed to emit a luminous radiation and has turns arranged in spiraling shape around an axis of revolution, which light bulb in addition comprises a plurality of supports, each having an end linked to the base and another end provided with a hook which is in contact with one of the turns of the filament, wherein one end of the filament is fixedly united to the vase and the other end of the filament is connected to said base via a rod situated within a region inside the turns of the filament and outside a plane defined by the axis of revolution and points of contact between the hooks and the filament.

2. The light bulb as claimed in claim 1, wherein the hooks are all situated at a same side of the axis of revolution of the filament.

3. The light bulb as claimed in claim 2, wherein the supports are designed so as to be situated above the filament in a direction opposite to a direction of mechanical deformation of the filament if the filament were not retained in position by the supports when the light bulb is in its normal operating position, and the hooks of the supports are open hooks.

4. A light bulb comprising:

a base;

a filament linked to the base, wherein the filament is designed to emit a luminous radiation, the filament having turns arranged in a spiraling shape around an axis of revolution; and a plurality of supports, each having an end linked to the base and another end provided with an open hook which is in contact with one of the turns of the filament, wherein the supports are designed so as to be situated above the filament in a direction opposite to a direction of mechanical deformation of the filament if the filament were not retained in position by the supports when the light bulb is in its normal operation position, wherein the hooks are all situated at a same side of the axis of revolution of the filament, further wherein a first end of the filament is fixedly united to the base and other end of the filament is connected to said base via a rod situated within a region inside the turns of the filament and outside a plane defined by the axis of revolution and points of contact between the hooks and the filament.

* * * * *